United States Patent [19]

Henry

[11] Patent Number: 4,512,049

[45] Date of Patent: Apr. 23, 1985

[54] RECREATIONAL TOWEL

[76] Inventor: Jill Henry, 193 Pavahilani Pl., Kailua, Hi. 96734

[21] Appl. No.: 630,533

[22] Filed: Jul. 13, 1984

[51] Int. Cl.[3] ..... A47G 9/06; B32B 3/02

[52] U.S. Cl. ..... 5/417; 428/100; 428/128; 428/193

[58] Field of Search ..... 428/99, 100, 126, 128, 428/193; 5/417, 419, 420; 52/3, 4

[56] References Cited

U.S. PATENT DOCUMENTS 2,907,057 10/1969 Specht ..... 5/417

FOREIGN PATENT DOCUMENTS 2510863 9/1976 Fed. Rep. of Germany ..... 5/420

*Primary Examiner*—Alexander S. Thomas

*Attorney, Agent, or Firm*—Maurice U. Cahn

[57] ABSTRACT

A recreational towel type device specifically designed for absorbing moisture and use as a ground or furnishing cover, capable of being secured to the covered surface and further being capable securing other objects is provided.

1 Claim, 6 Drawing Figures

RECREATIONAL TOWEL

This invention relates to articles associated with recreational activities. More particularly, this invention relates to moisture absorbing towels and their designs which are directed for use as coverings for ground or various outdoor furnishings.

BACKGROUND OF THE INVENTION

Towels are generally employed to absorb moisture. For recreational purposes, particularly those directed to water sports, towels are manufactured of soft, moisture-absorbing fabrics which are acceptable for direct contact with and drying skin. In addition to the primary function, towels often double as a covering to provide a clean or cushioned surface for the user. Commonly towels employed as such are spread on the ground or over an article of furniture. One problem generally assoc-iated with the use of a towel as a ground or furnishing covering is when subjected to a strong breeze it will often blow around and require subsequent rearrangement by the user. For example, when a towel is draped over a chaise lounge, a moderate wind will easily move the towel from its desired position.

It is therefore desirable to provide a towel which is configured for use in particular situations and is able to be secured to prevent dislocation from the original position selected by the user.

The principal object of this invention is to satisfy the foregoing purposes by providing a moisture absorbing towel configured to be used in particular situations and capable of being secured on the ground or on particular furnishings by the user.

DETAILED DESCRIPTION OF THE DRAWINGS

Figure 1:
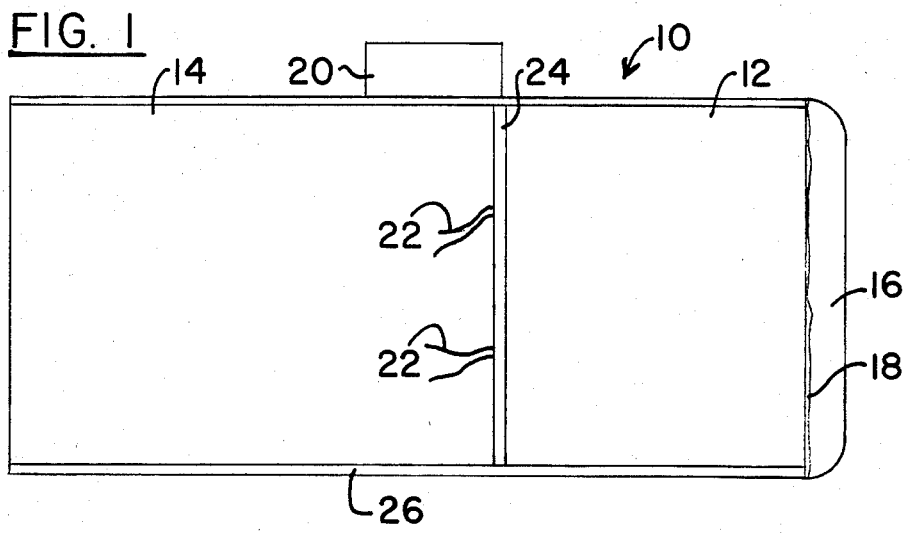
FIG. 1 is a bottom view of one preferred embodiment of this invention.
Figure 2:
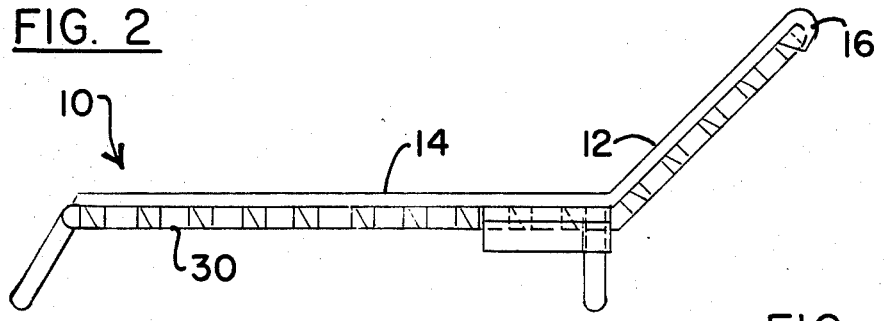
FIG. 2 is a slight perspective drawing of the first preferred embodiment of this invention illustrated in FIG. 1 positioned in accordance with its intended use.
Figure 3:
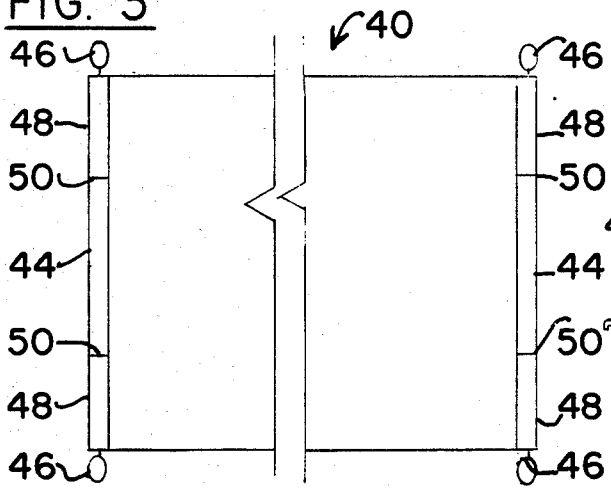
FIG. 3 is a top view of a second preferred embodiment of this invention.

Referring now to FIGS. 1 and 2, towel 10 adapted for use with a chaise lounge generally associated with swimming and tanning. Towel 10 is generally manufactured from a soft, absorbent, material such as terry cloth (80% cotton and 20% polyester) or other adequate moisture absorbing material. Towel 10 is composed of torso section 12 and leg section 14. Disposed along the upper edge of torso section 12 is overlap section 16 which is constructed by folding a short length (3 inches) of fabric over itself and sewing or otherwise securely affixing elastic strap member 18 along the edge of overlapping section 16 and section 12. One such affixation method is sewing the elastic strap to the tufted overlap 12 and the contiguous edge of section 12. By such construction, overlap section 16, as better illustrated in FIG. 2, forms an approximate 3" wide inwardly facing pocket which is able to be secured around the top of chaise lounge 30.

Pocket member 20 extends from one side of towel 10 which is adapted to overhang the edge of chaise lounge 30 when towel 10 is properly positioned as illustrated in FIG. 2. Pocket is constructed to hold miscellaneous articles such as suntan lotion, sun glasses, etc.

Torso section 12 and leg section 14 are joined at seam 24 which extends across their respective widths. Nylon strings 22 are sewn into seam 24. These strings are formed from $\frac{1}{8}$" diameter nylon cord and are approximately six inches long. Their purpose is to permit towel 10 to be tied to chaise lounge 30 so that towel 10 is secured to lounge 30 in a position illustrated in FIG. 2. The edges of towel 10 feature seamed borders 26 which are not necessary but a $\frac{1}{4}$ inch overlap provides additional structural strength to towel 10 and prevents fraying and other wear along the edges.

FIGS. 3 through 6 relate to the second preferred embodiment of the invention. Towel 40 is particularly adapted for placement and securing to the ground or a sandy beach. The predominant features of towel 40 include rectangularly shaped, terry cloth sheet 42, 4 inch wide edge overlaps 44 and protruding loops 46 disposed at each of the four corners and extending from the edge overlaps 44. Edge overlaps 44 further include pocket members 48, one located at each of the four corners. Loops 46 of overlap 44 extend from pockets 48. Loops 46, one sewn into or otherwise attached to each pocket member 48, are formed from $\frac{1}{4}$ inch diameter nylon cord.

Figure 4:
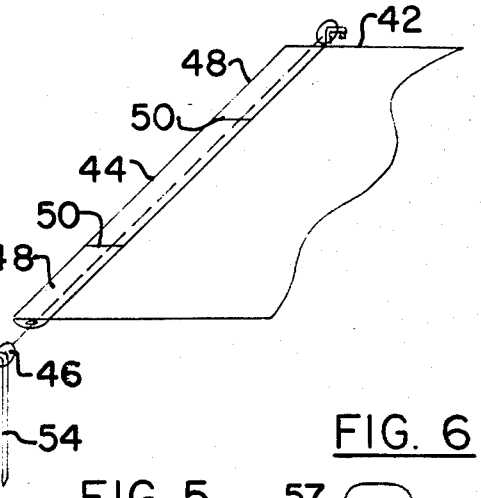
FIG. 4 is a cutaway perspective view of the second preferred embodiment of this invention.

The perspective view of FIG. 4 better illustrates the relative configuration of edge overlap 44 and the relationship of seams 50 thereto. Oppositely disposed pockets 48 are formed at each end of overlap section 44 and are defined by the outer edge of towel 40 and seams 50. Seams 50 are located approximately 14 inches from the respective edges of overlaps 44. These pockets provide a storage space for spikes 54 one of which fits into each of the four pockets 48 formed within edges 44. The purpose of spikes 54 is disclosed below.

Figure 5:
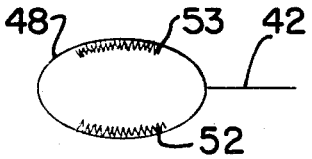
FIG. 5 is a cutaway side view of one end of the second preferred embodiment of this invention.

In FIG. 5, greater detail of the interior of pocket 48 is illustrated. Pocket 48 includes complementary and mating Velcro strips 52 and 53 which, when pressed together, securely close the opening of pocket 48. One-half inch wide Velcro strips have been determined to be adequate for this purpose. Pockets 48 are specifically designed to securely house spikes 54. When not in use one spike 54 is placed inside one pocket 48 and Velcro strips 52 and 53 are engaged by pressing together. In this way spikes 54 will not be misplaced or separated from towel 40.

Figure 6:
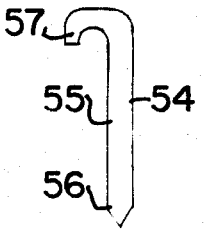
FIG. 6 is a side view of a spike contemplated for use with the second preferred embodiment of this invention.

Spike 54 generally illustrated in FIG. 6 is of a conventional nature having hook end 57, central extending portion 55 and beveled end 56. End 56 is driven into the sand or soil on which the blanket is laid. If spikes 54 extend through and engage loops 46 as illustrated in FIG. 4, towel 40 will be secured to the ground so as not to blow freely in the wind. The arrangement disclosed is therefore directed to not only securing towel 40 to the ground or beach but also to provide a convenient storage means for spikes 54.

Other embodiments, variations and modifications of the invention disclosed herein should now be obvious to one or ordinary skill of the art and are intended to fall within the scope of the following claims.

I claim:

1. A towel comprising, (a) a generally rectangular sheet of soft, moisture absorbing fabric, (b) two elongated overlapping portions located along opposite edges of said sheet, (c) elongated pockets formed at each of the ends of said elongated overlapping portions and being defined by the width of said overlapping portions and a seam thereacross, (d) loop members extending from the opening of each of said pockets, (e) means for securing said opening in a closed position, and (f) spike members being adapted to be driven into an underlying substrate, said spike members fitting within said pockets and secured therein when said securing means is in the closed position, said spikes further being slidable in and engagable with said loops so that when said spikes are removed from said pockets, engaged within said loops and driven into an underlying surface, the towel is secured to said surface.

* * * * *